US012449141B2

(12) United States Patent
Warner

(10) Patent No.: US 12,449,141 B2
(45) Date of Patent: Oct. 21, 2025

(54) DESICCANT HEAT EXCHANGER FOR HIGH EFFICIENCY DEHUMIDIFICATION

(71) Applicant: Copeland LP, Sidney, OH (US)

(72) Inventor: Jason Warner, Greenville, OH (US)

(73) Assignee: Copeland LP, Sidney, OH (US)

( * ) Notice: Subject to any disclaimer, the term of this patent is extended or adjusted under 35 U.S.C. 154(b) by 23 days.

(21) Appl. No.: 17/659,769

(22) Filed: Apr. 19, 2022

(65) Prior Publication Data

US 2023/0332779 A1 Oct. 19, 2023

(51) Int. Cl.
*F24F 3/14* (2006.01)

(52) U.S. Cl.
CPC ..... *F24F 3/1411* (2013.01)

(58) Field of Classification Search
CPC . F24F 3/1411; F24F 2003/1458; F24F 3/1417
See application file for complete search history.

(56) References Cited

U.S. PATENT DOCUMENTS

| | | | | |
|---|---|---|---|---|
| 4,941,324 | A | 7/1990 | Peterson et al. | |
| 5,943,874 | A | 8/1999 | Maeda | |
| 6,216,483 | B1 | 4/2001 | Potnis et al. | |
| 9,631,848 | B2 | 4/2017 | Vandermeulen et al. | |
| 10,323,867 | B2 * | 6/2019 | Vandermeulen | F24F 3/147 |
| 10,655,870 | B2 | 5/2020 | Lowenstein | |
| 10,941,948 | B2 | 3/2021 | Vandermeulen et al. | |
| 11,029,045 | B2 | 6/2021 | Woods et al. | |
| 11,131,468 | B2 | 9/2021 | Edstrom et al. | |
| 2013/0056177 | A1 * | 3/2013 | Coutu | F24F 12/002 165/104.11 |

(Continued)

FOREIGN PATENT DOCUMENTS

| | | | | |
|---|---|---|---|---|
| CN | 112728658 A | * | 4/2021 | F24F 12/00 |
| EP | 2309193 A1 | | 4/2011 | |

(Continued)

OTHER PUBLICATIONS

Translated_Chen (Year: 2021).*
International Search Report and Written Opinion issued in PCT/US2023/018312 mailed on Jul. 31, 2023, pp. 1-15.

*Primary Examiner* — Jerry-Daryl Fletcher
*Assistant Examiner* — Samba Gaye
(74) *Attorney, Agent, or Firm* — Armstrong Teasdale LLP

(57) ABSTRACT

A conditioning system includes a humidity control system, a vapor compression system, and a heat exchanger. The humidity control system includes a first fan producing a first airflow, a first mass exchange device in the first airflow, a second fan producing a second airflow, and a second mass exchange device in the second airflow and in fluid communication with the first mass exchange device permitting a liquid desiccant to flow in a liquid desiccant loop. The vapor compression system includes an evaporator, and a condenser in fluid communication with the evaporator permitting a refrigerant to flow in a refrigerant loop. The heat exchanger has a first path in fluid communication with the humidity control system permitting the liquid desiccant to flow therethrough and a second path thermally coupled to the first path and in fluid communication with the vapor compression system permitting a refrigerant to flow therethrough.

20 Claims, 14 Drawing Sheets

(56) References Cited

U.S. PATENT DOCUMENTS

| | | | | |
|---|---|---|---|---|
| 2013/0227982 | A1* | 9/2013 | Forkosh | F24F 3/1429<br>62/271 |
| 2014/0150481 | A1 | 6/2014 | Vandermeulen | |
| 2014/0260399 | A1 | 9/2014 | Vandermeulen | |
| 2015/0338140 | A1 | 11/2015 | Vandermeulen | |
| 2019/0145640 | A1 | 5/2019 | Vandermeulen et al. | |

FOREIGN PATENT DOCUMENTS

| | | | |
|---|---|---|---|
| WO | 2011150081 | A2 | 12/2011 |
| WO | 2015143332 | A2 | 9/2015 |

* cited by examiner

DESICCANT HEAT EXCHANGER FOR HIGH EFFICIENCY DEHUMIDIFICATION

FIELD OF THE DISCLOSURE

The field of the disclosure relates generally to heating, ventilation, and air conditioning (HVAC) systems, and more specifically, to the use of humidity control systems in HVAC systems.

BACKGROUND

The vapor compression cycle is widely used in air conditioning systems to regulate the temperature and humidity of an indoor space. In some applications, vapor compression systems are used in parallel with liquid desiccant dehumidification systems to remove moisture from the air without cooling it below its dew point temperature. In such systems, a liquid desiccant stream flows in a loop between a conditioner, where it absorbs moisture from the cooled interior air, and a regenerator, where it releases moisture into the warm outdoor environment.

The liquid desiccant stream is cyclically cooled in the conditioner and heated in the regenerator, and any energy expended to change the temperature of the liquid desiccant stream is a source of inefficiency for the humidity control system. Thus, there is a need for a conditioning system that can achieve the required liquid desiccant temperatures for conditioning and regeneration without significant efficiency losses.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of this disclosure is a conditioning system including a humidity control system, a vapor compression system, and a heat exchanger. The humidity control system includes a first fan for producing a first airflow toward a conditioned interior space, a first mass exchange device positioned in the first airflow, a second fan for producing a second airflow toward an exterior space, and a second mass exchange device positioned in the second airflow. The first mass exchange device and the second mass exchange device are coupled in fluid communication to permit a liquid desiccant to flow in a first loop therebetween. The vapor compression system includes an evaporator coupled in fluid communication with the first mass exchange device to permit a first heat transfer fluid to flow in a second loop therebetween, and a condenser coupled in fluid communication with the second mass exchange device to permit a second heat transfer fluid to flow in a third loop therebetween. The evaporator and condenser are coupled in fluid communication to permit a third heat transfer fluid to flow in a fourth loop therebetween. The heat exchanger has a first path in fluid communication with the humidity control system to permit the liquid desiccant to flow therethrough and a second path thermally coupled to the first path and in fluid communication with the vapor compression system to permit one of the first, second, or third heat transfer fluids to flow therethrough.

According to another aspect of this disclosure, a conditioning system includes a chiller, a conditioner, and a regenerator. The chiller includes an evaporator and a condenser, wherein the evaporator and the condenser are coupled in fluid communication to permit a refrigerant to flow in a refrigerant loop therebetween. The conditioner includes a first fan for producing a first airflow toward a conditioned interior space, and a first mass exchange device positioned in the first airflow, wherein the conditioner is fluidly connected to the chiller to permit a first heat transfer fluid to flow in a conditioning loop between the first mass exchange device and the evaporator. The regenerator includes a second fan for producing a second airflow toward the conditioned interior space, and a second mass exchange device positioned in the second airflow, wherein the regenerator is fluidly coupled to the chiller to permit a second heat transfer fluid to flow in a regenerating loop between the second mass exchange device and the condenser, and wherein the regenerator is fluidly coupled to the conditioner to permit a liquid desiccant to flow in a liquid desiccant loop between the second mass exchange device and the first mass exchange device. At least one of the chiller, the regenerator, or the conditioner includes a heat exchanger having a first path in fluid communication with the liquid desiccant loop to permit liquid desiccant to flow therethrough, and a second path thermally coupled to the first path and in fluid communication with one of the refrigerant loop, conditioning loop, or regenerating loop to permit one of the refrigerant, first heat transfer fluid, or second heat transfer fluid to flow therethrough.

In yet another aspect, a conditioning system includes a humidity control system, a vapor compression system, and a heat exchanger. The humidity control system includes a first fan for producing a first airflow toward a conditioned interior space, a first mass exchange device positioned in the first airflow, a second fan for producing a second airflow toward an exterior space, and a second mass exchange device positioned in the second airflow and coupled in fluid communication with the first mass exchange device to permit a liquid desiccant to flow in a liquid desiccant loop therebetween. The vapor compression system includes an evaporator, and a condenser coupled in fluid communication with the evaporator to permit a refrigerant to flow in a refrigerant loop therebetween. The heat exchanger has a first path in fluid communication with the humidity control system to permit the liquid desiccant to flow therethrough and a second path thermally coupled to the first path and in fluid communication with the vapor compression system to permit a refrigerant to flow therethrough.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

For conciseness, examples will be described with respect to a conditioning system that cools and dehumidifies an indoor space. However, the systems described herein may be applied to any suitable system for regulating the temperature and humidity of a space, including those that heat and/or humidify a space. The temperature and humidity of an indoor space can be regulated using a conditioning system that includes a humidity control system and a vapor compression system. The humidity control system uses a liquid desiccant loop to dehumidify the air by absorbing moisture from the indoor space in a conditioner and releasing it into an outdoor space in a regenerator. The vapor compression system cools the liquid desiccant in the conditioner to increase its capacity to absorb moisture and warms the liquid desiccant in the regenerator to increase its capacity to release moisture. The overall system efficiency can be improved by adding a heat exchanger between the vapor compression system and the humidity control system to transfer heat between the two cycles at an optimized location.

Figure 1:
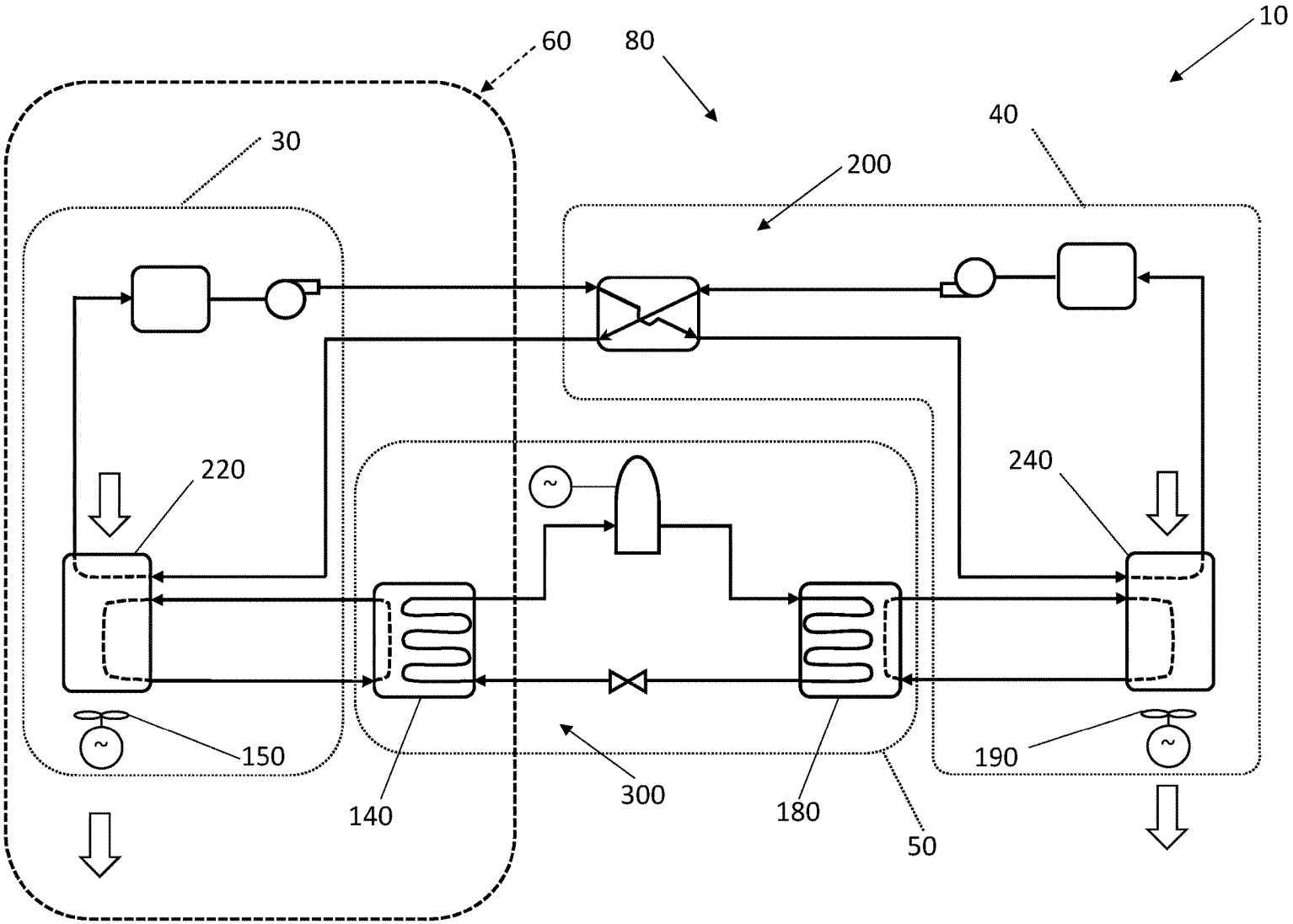
FIG. 1 is a schematic view of an exemplary embodiment of a conditioning system including a humidity control system and a vapor compression system.

FIG. 1 is a schematic diagram of a conditioning system 10 for cooling and dehumidifying a conditioned interior space 60 surrounded by an exterior space 80. The conditioning system 10 includes a humidity control system 200 and a vapor compression system 300 that are thermally coupled to cooperatively condition the conditioned interior space 60. A conditioner 30 including a first mass exchange device 220 and a first fan 150 cools and dehumidifies the conditioned interior space 60 by absorbing moisture into a liquid desiccant stream. A regenerator 40 including a second mass exchange device 240 and a second fan 190 expels moisture into the exterior space 80 to regenerate the liquid desiccant stream. A chiller 50 including an evaporator 140 and a condenser 180 is operable to cool the liquid desiccant in the conditioner 30 and warm the liquid desiccant in the regenerator 40. The conditioner 30, regenerator 40, and chiller 50 will be discussed in greater detail further below.

Figure 2:
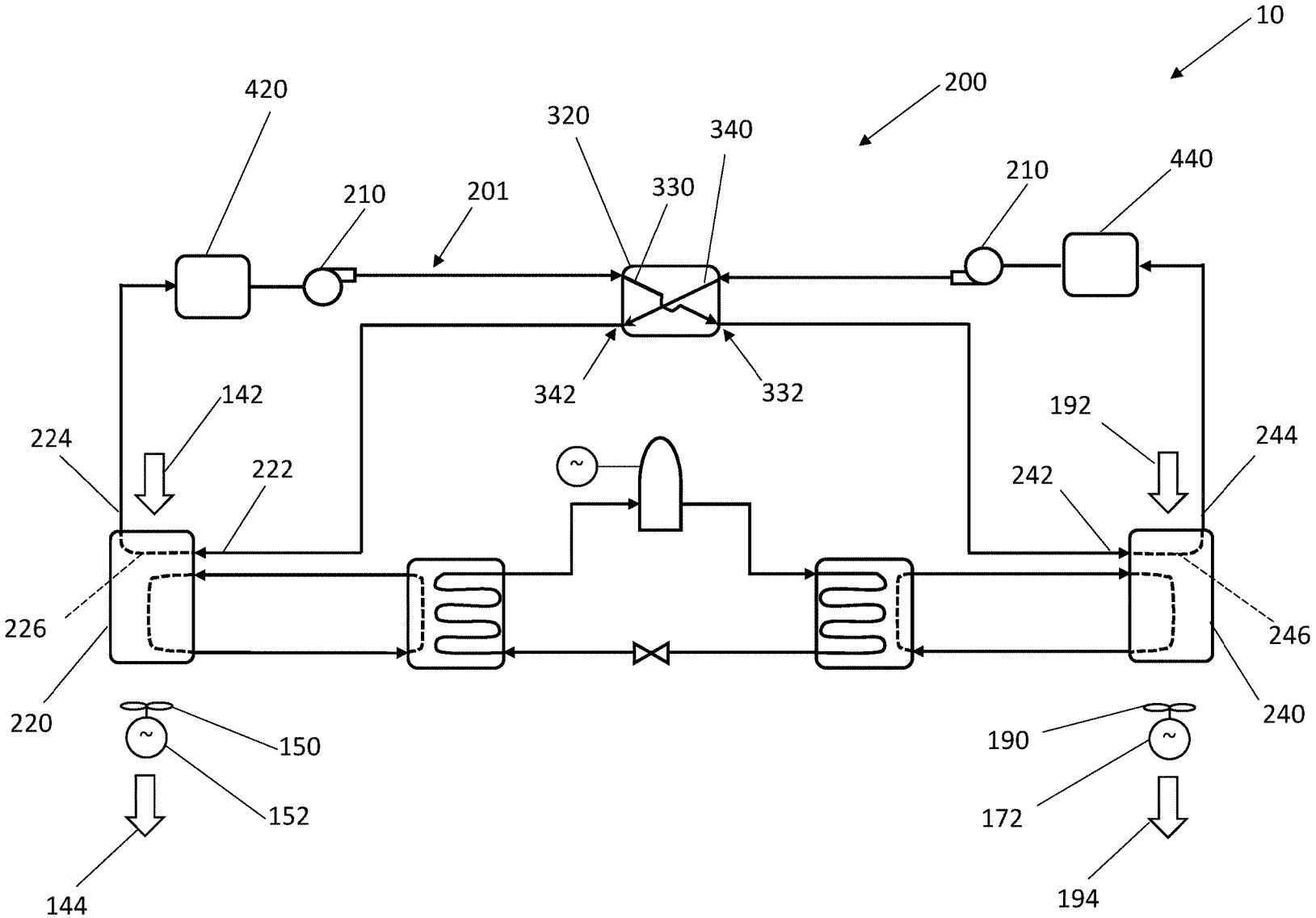
FIG. 2 is a schematic view of the exemplary embodiment of the conditioning system shown in FIG. 1, highlighting the humidity control system.

With reference to FIG. 2, the humidity control system 200 includes a first loop 201 (also referred to as a liquid desiccant loop) configured to permit liquid desiccant to flow therethrough to cool and dehumidify the conditioned interior space 60. The first loop 201 is shown in black, and portions of the conditioning system 10 that are not part of the first loop 201 are shown in grey. Any suitable liquid desiccant can be used that allows the humidity control system 200 to function as described herein, for example and without limitation, lithium chloride or calcium chloride. Although described in connection with the vapor compression system 300, the humidity control system 200 may be used as a stand-alone humidity control system without the vapor compression system 300, or may be used in connection with any other suitable HVAC system.

The liquid desiccant cools and dehumidifies the conditioned interior space 60 by absorbing moisture from the conditioned interior space 60 and releasing moisture into the exterior space 80. When the liquid desiccant is at a low temperature and a low water concentration, its vapor pressure is less than that of the surrounding air, and the liquid desiccant will absorb moisture therefrom to condition the air. However, the liquid desiccant's effectiveness is reduced as it becomes diluted with water. The water-concentrated liquid desiccant can subsequently be heated to a temperature at which its vapor pressure is higher than that of the surrounding air, causing moisture to evaporate out of the liquid desiccant and into the air. Releasing moisture from the liquid desiccant reduces both its water concentration and its temperature, thereby regenerating the liquid desiccant and enabling it to be reused.

The humidity control system 200 includes the first mass exchange device 220 for dehumidifying the conditioned interior space 60, the second mass exchange device 240 for regenerating the liquid desiccant, and a liquid desiccant heat exchanger 320 coupled in fluid communication with both the first and second mass exchange devices 220, 240. The first fan 150 produces a first airflow 142 across the first mass exchange device 220 toward the conditioned interior space 60. The first fan 150 may be driven by a first variable frequency drive (VFD) 152 or any other suitable motor. As the first airflow 142 passes through the first mass exchange device 220, the cool liquid desiccant in the first mass exchange device 220 absorbs moisture from the air. The first airflow 142 is thereby dehumidified in the first mass exchange device 220 and enters the conditioned interior space 60 as a conditioned airflow 144.

The second fan 190 produces a second airflow 192 across the second mass exchange device 240 toward the exterior space 80. The second fan 190 may be driven by a second VFD 172 or any other suitable motor. As the second airflow 192 passes through the second mass exchange device 240, the warm, water-diluted liquid desiccant in the second mass exchange device 240 releases moisture into the air. The liquid desiccant is thereby regenerated, and the second airflow 192 enters the exterior space 80 as an exhaust airflow 194.

The first mass exchange device 220 has an inlet 222 and an outlet 224, and may include at least one first cavity 226 extending between the inlet 222 and the outlet 224 such that liquid desiccant flows therebetween. Liquid desiccant may flow through each first cavity 226 in a direction opposite the direction of the first airflow 142, in the same direction as the first airflow 142, perpendicular to the first airflow 142, or in any other suitable direction relative to the first airflow 142. The at least one first cavity 226 is thermally connected to a first conditioning path 228 (FIG. 4) of the first mass exchange device 220, which will be discussed in greater detail further below.

Each first cavity 226 may include an open portion positioned to be exposed to the first airflow 142. The open portion of each first cavity 226 may be covered by a first vapor-permeable membrane having a plurality of pores that are sized to allow water vapor molecules to pass through while prohibiting the passage of larger molecules, such as molecules of the liquid desiccant. Thus, the first vapor permeable membrane allows moisture from the first airflow 142 to pass through the membrane and be absorbed by the liquid desiccant, thereby dehumidifying the air. The first vapor permeable membrane also prevents liquid desiccant from leaking out of the first cavity 226 and into the first airflow 142.

Similarly, the second mass exchange device 240 has an inlet 242 and an outlet 244, and may include at least one second cavity 246 extending between the inlet 242 and the outlet 244 such that liquid desiccant flows therebetween. Liquid desiccant may flow through each second cavity 246 in a direction opposite the direction of the second airflow 192, in the same direction as the second airflow 192, perpendicular to the second airflow 192, or in any other suitable direction relative to the second airflow 192. The at least one second cavity 246 is thermally connected to a first regenerating path 248 (FIG. 4) of the second mass exchange device 240, which will be discussed in greater detail further below.

Each second cavity 246 may include an open portion positioned to be exposed to the second airflow 192. The open portion may be covered by a second vapor-permeable membrane having a plurality of pores that are sized to allow water vapor molecules to pass through while prohibiting the passage of larger molecules, such as molecules of the liquid desiccant. Thus, the second vapor permeable membrane allows moisture in the liquid desiccant to pass through the membrane and be released into the second airflow 192 to regenerate the liquid desiccant. The second vapor permeable membrane also prevents liquid desiccant from leaking out of the second cavity 246 and into the second airflow 192.

The first and second mass exchange devices 220, 240 are coupled in fluid communication with the liquid desiccant heat exchanger 320. The liquid desiccant heat exchanger 320 (also referred to as a supplemental heat exchanger 320) includes a first liquid desiccant path 330 and a second liquid desiccant path 340 that are adjacent and thermally coupled to one another. The first liquid desiccant path 330 of the liquid desiccant heat exchanger 320 is in fluid communication with both the outlet 224 of the first mass exchange device 220 and the inlet 242 of the second mass exchange device 240. The liquid desiccant exiting the first mass exchange device 220 is cold from thermal contact with a first heat transfer fluid and flows through the first liquid desiccant path 330 of the liquid desiccant heat exchanger 320 in a first direction 332 oriented from the first mass exchange device 220 to the second mass exchange device 240. The first heat transfer fluid will be discussed in greater detail further below with respect to FIG. 4.

The second liquid desiccant path 340 of the liquid desiccant heat exchanger 320 is in fluid communication with both the outlet 244 of the second mass exchange device 240 and the inlet 222 of the first mass exchange device 220. The liquid desiccant exiting the second mass exchange device 240 is warm from thermal contact with a second heat transfer fluid and flows through the second liquid desiccant path 340 in a second direction 342 oriented from the second mass exchange device 240 to the first mass exchange device 220. The second heat transfer fluid will be discussed in greater detail further below with respect to FIG. 4. The thermal contact between the first liquid desiccant path 330 and the second liquid desiccant path 340 causes the warm liquid desiccant in the second liquid desiccant path 340 to be pre-cooled prior to entering the first mass exchange device 220, increasing its capacity to absorb moisture from the first airflow 142. The thermal contact between the two liquid desiccant paths 330, 340 also causes the cold liquid desiccant in the first liquid desiccant path 330 to be pre-heated prior to entering the second mass exchange device 240, improving its ability to release moisture into the second airflow 192.

The liquid desiccant heat exchanger 320 may be configured in a counterflow configuration in which the first and second directions 332, 342 are opposite, parallel directions. In further embodiments, the first and second directions 332, 342 may be perpendicular, parallel, or in any other suitable orientation.

The humidity control system 200 further includes at least one liquid desiccant tank for holding liquid desiccant downstream of one of the mass exchange devices 220, 240. In the embodiment illustrated in FIG. 2, a first liquid desiccant tank 420 is located between the first mass exchange device 220 and the liquid desiccant heat exchanger 320. The first liquid desiccant tank 420 is in fluid communication with both components, receiving liquid desiccant from the first mass exchange device 220 and providing liquid desiccant to first liquid desiccant path 330 of the liquid desiccant heat exchanger 320. The first liquid desiccant tank 420 may be integral with the first mass exchange device 220, and both components may be enclosed by a first housing (not shown). In further embodiments, they may be separate, non-integral components.

Similarly, a second liquid desiccant tank 440 is located between the second mass exchange device 240 and the liquid desiccant heat exchanger 320. The second liquid desiccant tank 440 is in fluid communication with both components, receiving liquid desiccant from the second mass exchange device 240 and providing it to the second liquid desiccant path 340 of the liquid desiccant heat exchanger 320. The second liquid desiccant tank 440 may be integral with the second mass exchange device 240, and both components may be enclosed by a second housing (not shown). In further embodiments, they may be separate, non-integral components.

The volume of liquid desiccant in each of the first and second liquid desiccant tanks 420, 440 can be constant; that is, liquid desiccant is received from the first or second mass exchange device 220, 240 at the same rate as it is provided to the liquid desiccant heat exchanger 320. Alternatively, the volume of liquid desiccant in each tank 420, 440 may vary over time to allow precise control of the rate at which liquid desiccant is provided to the liquid desiccant heat exchanger 320.

At least one pump 210 is fluidly coupled to the first liquid desiccant tank 420, the second liquid desiccant tank 440, and the liquid desiccant heat exchanger 320. The at least one pump 210 is configured to circulate liquid desiccant in a loop through the conditioning process in the first mass exchange device 220 and the regenerating process in the second mass exchange device 240. The embodiment illustrated in FIG. 2 includes two pumps 210, but the humidity control system 200 may include any suitable number of pumps 210, for example and without limitation, one, three, or more.

Each of the pumps 210 illustrated in FIG. 2 is located downstream of one of the first or second liquid desiccant tank 420, 440. Each pump 210 is operable to control the rate at which liquid desiccant is supplied from the liquid desiccant tank 420, 440 to the liquid desiccant heat exchanger 320, and to the respective mass exchange device 220, 240 downstream of each path of the liquid desiccant heat exchanger 320. The integration of a liquid desiccant tank and a pump with each mass exchange device simplifies the system's piping and storage capabilities, and allows for the fluid pressure of the liquid desiccant within each mass exchange device to be controlled within a small pressure range. The at least one pump 210 may be a centrifugal pump, diaphragm pump, reciprocating pump, vane pump, screw pump, gear pump, or any type of pump that allows the humidity control system 200 to function as described herein.

In some embodiments, the humidity control system 200 can be used to humidify, rather than dehumidify, the conditioned interior space 60 to provide evaporative cooling. In such embodiments, the humidity control system 200 may include a three-way valve (not shown) selectively configured to bypass the liquid desiccant heat exchanger 320 and the second mass exchange device 240 such that all of the liquid desiccant exiting the first mass exchange device 220 is routed back to the first mass exchange device 220 after leaving the first liquid desiccant tank 420. The first liquid desiccant tank 420 may include a connection to receive water from an external water source to be evaporated into the conditioned interior space. The external water source can be a municipal water source, a well, or any other suitable source. Further embodiments do not include a connection to receive water from an external water source.

Figure 3:
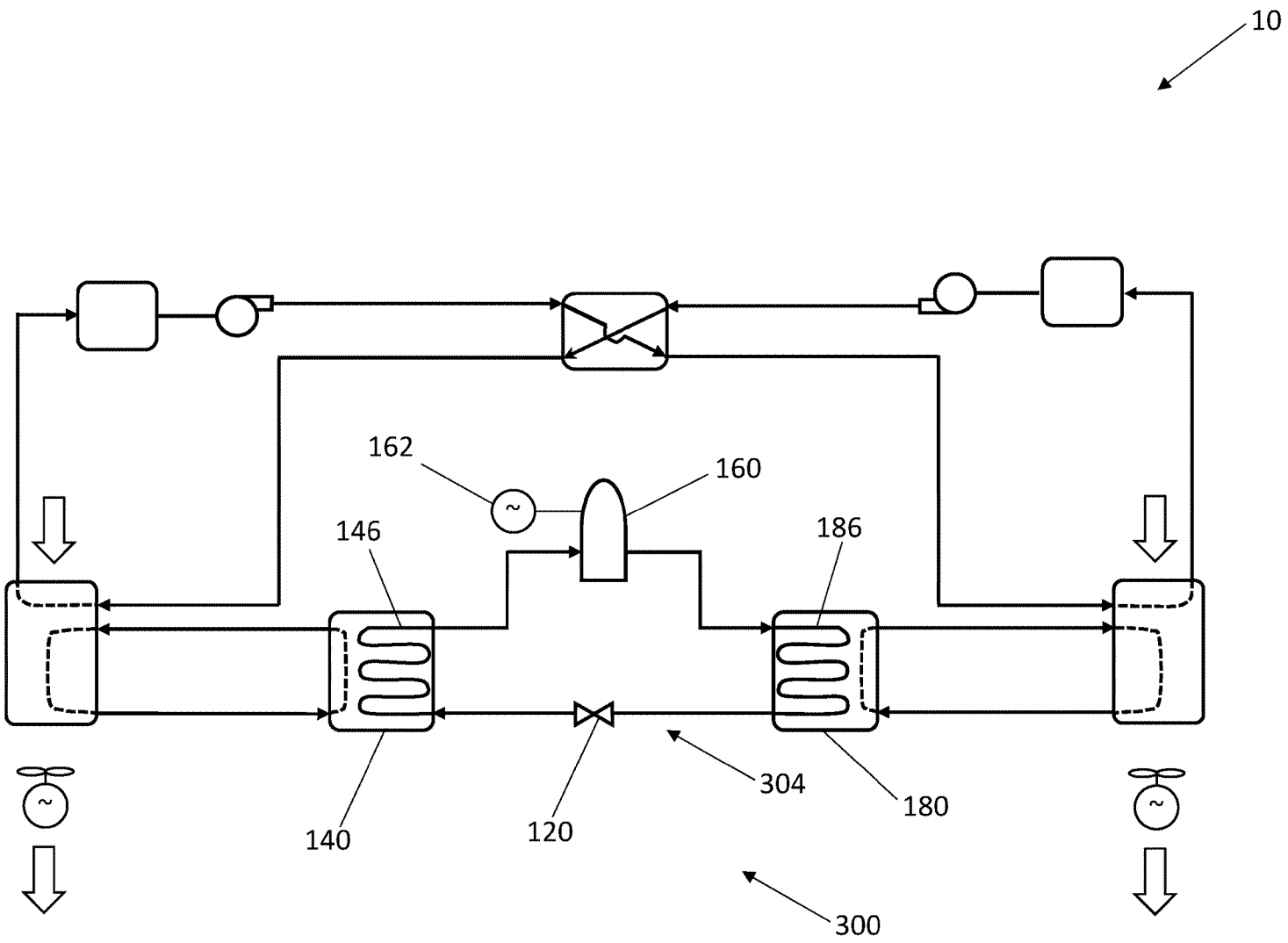
FIG. 3 is a schematic view of the exemplary embodiment of the conditioning system shown in FIG. 1, highlighting a refrigerant loop of the vapor compression system.
Figure 4:
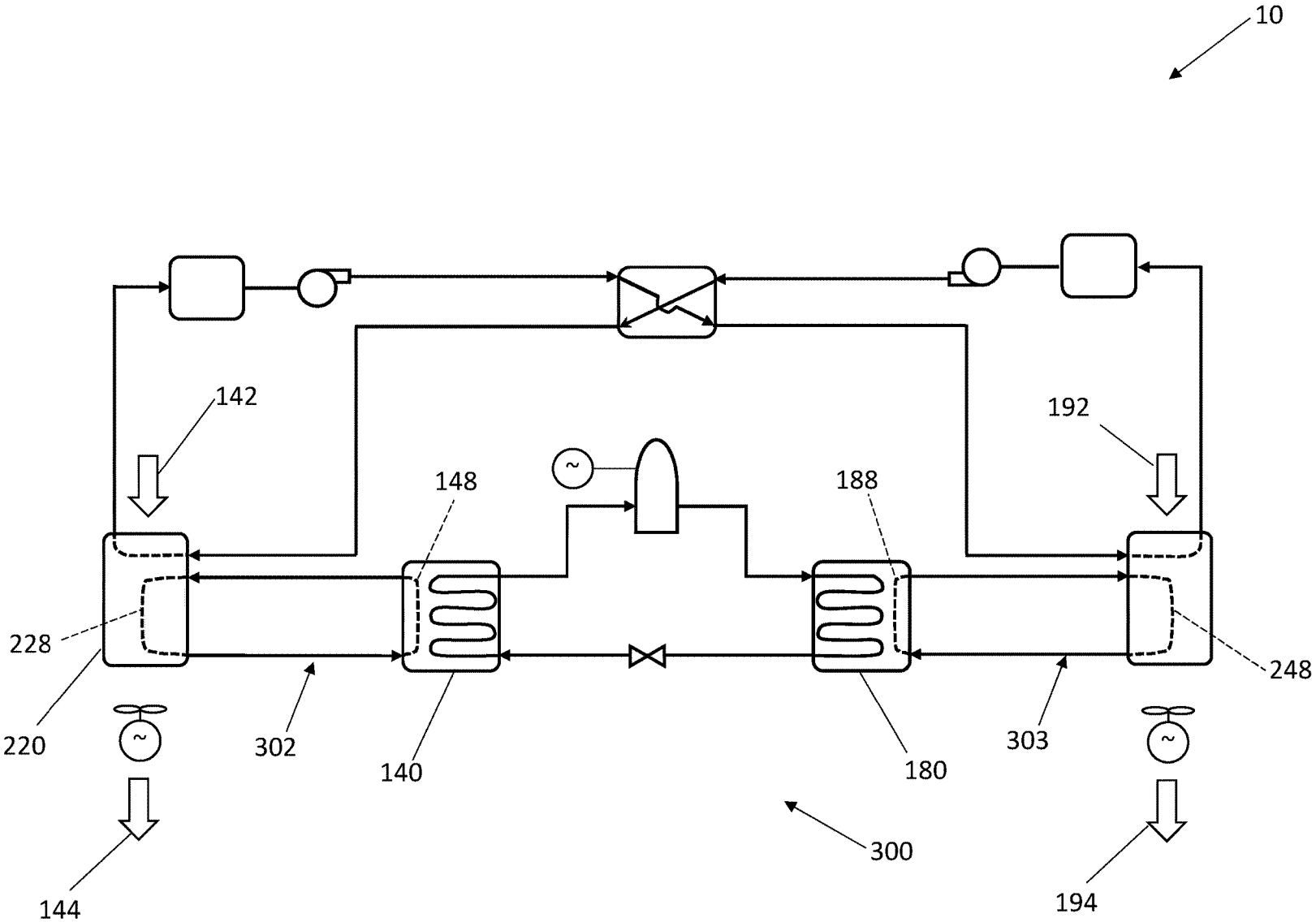
FIG. 4 is a schematic view of the exemplary embodiment of the conditioning system shown in FIG. 1, highlighting a conditioning loop and a regenerating loop of the vapor compression system.

With reference to FIGS. 3 and 4, the vapor compression system 300 of the conditioning system 10 includes the first and second mass exchange devices 220, 240 of the humidity control system 200, as well as an expansion device 120, an evaporator 140 (sometimes referred to as an indoor heat exchanger), a compressor 160, and a condenser 180 (sometimes referred to as an outdoor heat exchanger). The vapor compression system 300 is configured in three closed fluid loops. The evaporator 140 is coupled in fluid communication with the first mass exchange device 220 to permit a first heat transfer fluid to flow in a second loop 302 (also referred to as a conditioning loop) therebetween. The condenser 180 is coupled in fluid communication with the second mass exchange device 240 to permit a second heat transfer fluid to flow in a third loop 303 (also referred to as a regenerating loop) therebetween. The evaporator 140 and the condenser 180 are coupled in fluid communication to permit a third heat transfer fluid to flow in a fourth loop 304 (also referred to as a refrigerant loop) therebetween.

With reference to FIG. 3, the fourth loop 304 is configured to permit the third heat transfer fluid (also referred to as refrigerant) to flow therethrough. The fourth loop 304 is shown in black, and portions of the conditioning system 10 that are not part of the fourth loop 304 are shown in grey. The third heat transfer fluid can be a refrigerant, such as R-410A, or it can be any suitable heat transfer fluid that allows the humidity control system 200 to function as described herein.

Refrigerant enters the expansion device 120 as a high-pressure liquid. The expansion device 120 reduces the pressure of the refrigerant such that it exits as low-pressure, low-temperature liquid. In some embodiments, the pressure may be reduced until the liquid refrigerant's current temperature becomes the boiling point temperature at that pressure, and the refrigerant becomes a two-phase mixture as some of the liquid refrigerant boils and turns into a gas. The expansion device 120 may be any type of expansion device that allows the vapor compression system 300 to function as descried herein, for example and without limitation, a fixed orifice, a thermal expansion valve, or an electronic expansion valve.

The expansion device 120 is fluidly coupled to the evaporator 140, which includes a first refrigerant path 146 that receives refrigerant from the expansion device 120 and provides refrigerant to the compressor 160. The first refrigerant path 146 is thermally connected to a second conditioning path 148 (FIG. 4) fluidly connected to the second loop 302. The second conditioning path 148 receives the first heat transfer fluid from the first mass exchange device 220 and returns it thereto. The refrigerant in the first refrigerant path 146 of the evaporator 140 absorbs heat from the first heat transfer fluid in the second conditioning path 148 of the evaporator 140, thereby cooling the first heat transfer fluid as the refrigerant changes phase from a liquid to a gas. The second loop 302 will be discussed in greater detail further below.

The first refrigerant path 146 of the evaporator 140 is fluidly coupled to the compressor 160, where refrigerant enters as a low-pressure, low-temperature gas. The compressor 160 is operable to compress the refrigerant by increasing the pressure of the refrigerant, for example, by adding kinetic energy to the refrigerant and converting it to pressure rise. The compressor 160 may be any suitable compression device that allows the vapor compression system 300 to function as described herein, for example and without limitation, a dynamic compressor, a centrifugal compressor, an axial compressor, a scroll compressor, a rotary compressor, a screw compressor, a single-stage compressor, or a multi-stage compressor. The compressor 160 may be driven by a third VFD 162 or any other suitable motor. The refrigerant exits the compressor 160 as a high-pressure, high-temperature gas.

The compressor 160 is fluidly coupled to the condenser 180, which includes a second refrigerant path 186 that receives refrigerant from the compressor 160 and provides refrigerant to the expansion device 120. The second refrigerant path 186 is thermally connected to a second regenerating path 188 (FIG. 4) fluidly connected to the third loop 303. The second regenerating path 188 receives the second heat transfer fluid from the second mass exchange device 240 and returns it thereto. The refrigerant in the second refrigerant path 186 releases heat into the second heat transfer fluid in the second regenerating path 188, thereby warming the second heat transfer fluid as the refrigerant changes phase from a gas to a liquid. The third loop 303 will be discussed in greater detail further below. The second refrigerant path 186 of the condenser 180 is fluidly coupled to the expansion device 120, and the vapor compression cycle begins again.

In some embodiments, the fourth loop 304 of the vapor compression system 300 can be used as a heating system rather than as a cooling system. In such embodiments, a position of a four-way valve (not shown) can be switched to reverse the flow of refrigerant through the refrigerant loop. As a result, the condenser 180 functions as an evaporator for absorbing heat from the second heat transfer fluid in the third loop 303, and the evaporator 140 functions as a condenser for releasing heat into the first heat transfer fluid in the second loop 302.

With reference to FIG. 4, the second conditioning path 148 of the evaporator 140 is coupled in fluid communication with the first conditioning path 228 of the first mass exchange device 220 to permit a first heat transfer fluid to flow in a second loop 302 (also referred to as a conditioning loop) therebetween. The first heat transfer fluid may be water, glycol, refrigerant, or any suitable heat transfer fluid that allows the conditioning system 10 to function as described herein. After passing through the second conditioning path 148 and releasing heat into the refrigerant in the first refrigerant path 146 of the fourth loop 304, the cooled first heat transfer fluid is returned to the first conditioning path 228 of the first mass exchange device 220. The first conditioning path 228 is thermally coupled to the first cavity 226 of the first mass exchange device 220 in first loop 201, and the first heat transfer fluid absorbs heat from the liquid desiccant flowing therethrough. The liquid desiccant in the first mass exchange device 220 is left at a lower temperature, increasing its capacity to absorb moisture from the first airflow 142 to yield the conditioned airflow 144.

The second regenerating path 188 of the condenser 180 is coupled in fluid communication with the first regenerating path 248 of the second mass exchange device 240 to permit a second heat transfer fluid to flow in a third loop 303 (also referred to as a regenerating loop) therebetween. The second heat transfer fluid may be water, glycol, refrigerant, or any suitable heat transfer fluid that allows the conditioning system 10 to function as described herein. After passing through the condenser 180 and absorbing heat from the refrigerant in the second refrigerant path 186 of the fourth loop 304, the warm second heat transfer fluid is returned to the first regenerating path 248 of the second mass exchange device 240. The first regenerating path 248 is thermally coupled to the second cavity 246 of the second mass exchange device of the first loop 201, and the liquid desiccant flowing therethrough absorbs heat from the second heat transfer fluid. The liquid desiccant in the second mass exchange device 240 is left at a higher temperature, increasing its capacity to release moisture into the second airflow 192 to yield the exhaust airflow 194.

In some embodiments, the evaporator 140 and the condenser 180 are part of a chiller 50, the first fan 150 and the first mass exchange device 220 are part of a conditioner 30, and the second fan and the second mass exchange device 240 are part of a regenerator 40 (FIG. 1). In such embodiments, the conditioner 30 is fluidly connected to the chiller 50 by the second loop 302, allowing the first heat transfer fluid to flow in a conditioning loop between the first mass exchange device 220 and the evaporator 140. The regenerator 40 is fluidly connected to the chiller 50 by the third loop 303, allowing the second heat transfer fluid to flow in a regenerating loop between the second mass exchange device 240 and the condenser 180. The regenerator 40 is fluidly coupled to the conditioner 30 by the first loop 201, allowing the liquid desiccant to flow in a liquid desiccant loop between the second mass exchange device 240 and the first mass exchange device 220.

In some embodiments, and with reference to FIGS. 5-8, the conditioning system 10 may include a heat exchanger 520 in fluid communication with both the humidity control system 200 and the vapor compression system 300. The heat exchanger 520 includes a first path 530 in fluid communication with the first loop 201 (also referred to as the liquid desiccant loop) of the humidity control system 200 to permit the liquid desiccant to flow therethrough. The heat exchanger 520 also includes a second path 540 thermally coupled to the first path 530 and in fluid communication with the vapor compression system 300. The second path 540 of the heat exchanger 520 may be in fluid communication with one of the second loop 302 (also referred to as the conditioning loop), the third loop 303 (also referred to as the regenerating loop), or the fourth loop 304 (also referred to as the refrigerant loop) to permit one of the first heat transfer fluid, second heat transfer fluid, or third heat transfer fluid (also referred to as refrigerant) to flow therethrough. The mass flow rates of the first, second, and third heat transfer fluids are much larger than that of the liquid desiccant, which allows heat to be transferred very efficiently. A large temperature change in the liquid desiccant temperature may be achieved with just a small temperature change in the first, second, or third heat transfer fluids.

Figure 5:
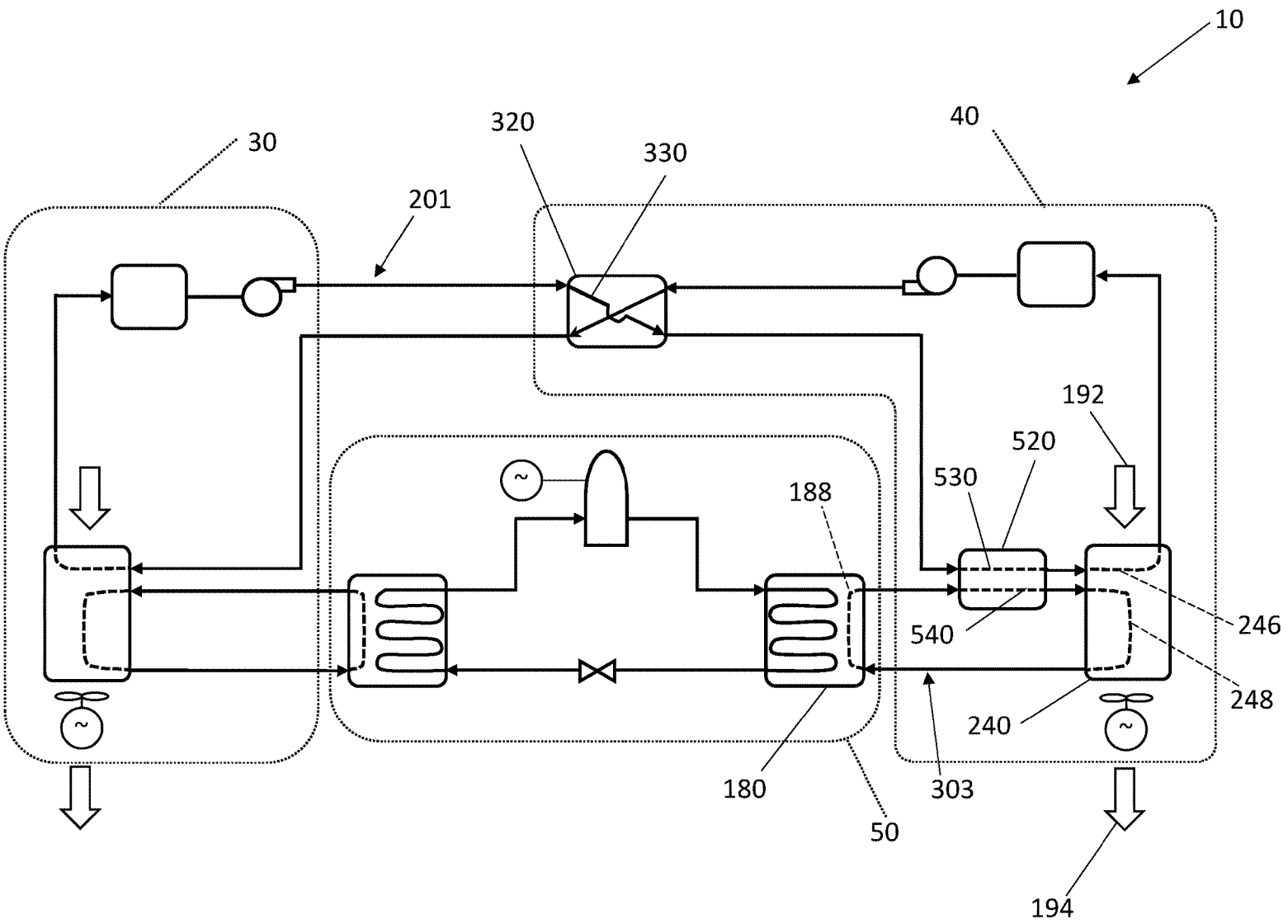
FIG. 5 is a schematic view of another exemplary embodiment of the conditioning system including a heat exchanger in a first configuration.

With reference to FIG. 5, the heat exchanger 520 may be part of the regenerator 40. In the illustrated embodiment, the first path 530 of the heat exchanger 520 is downstream of the liquid desiccant heat exchanger 320 in the first loop 201 such that liquid desiccant flows from the first liquid desiccant path 330 of the liquid desiccant heat exchanger 320 to the first path 530 of the heat exchanger 520. The first path 530 is also upstream of the second mass exchange device 240 such that liquid desiccant flows from the first path 530 of the heat exchanger 520 to the second cavity 246 of the second mass exchange device 240.

The second path 540 of the heat exchanger 520 is downstream of the condenser 180 in the third loop 303 such that the second heat transfer fluid flows from the second regenerating path 188 of the condenser to the second path 540 of the heat exchanger 520. The second path 540 is also upstream of the second mass exchange device 240 such that the second heat transfer fluid flows from the second path 540 of the heat exchanger 520 to the first regenerating path 248 of the second mass exchange device 240. The first and second paths 530, 540 of the heat exchanger 520 are thermally coupled such that the liquid desiccant in the first path 530 absorbs heat from the second heat transfer fluid in the second path 540, increasing its capacity to release moisture into the second airflow 192, thereby improving the performance and efficiency of the regenerator 40.

Figure 6:
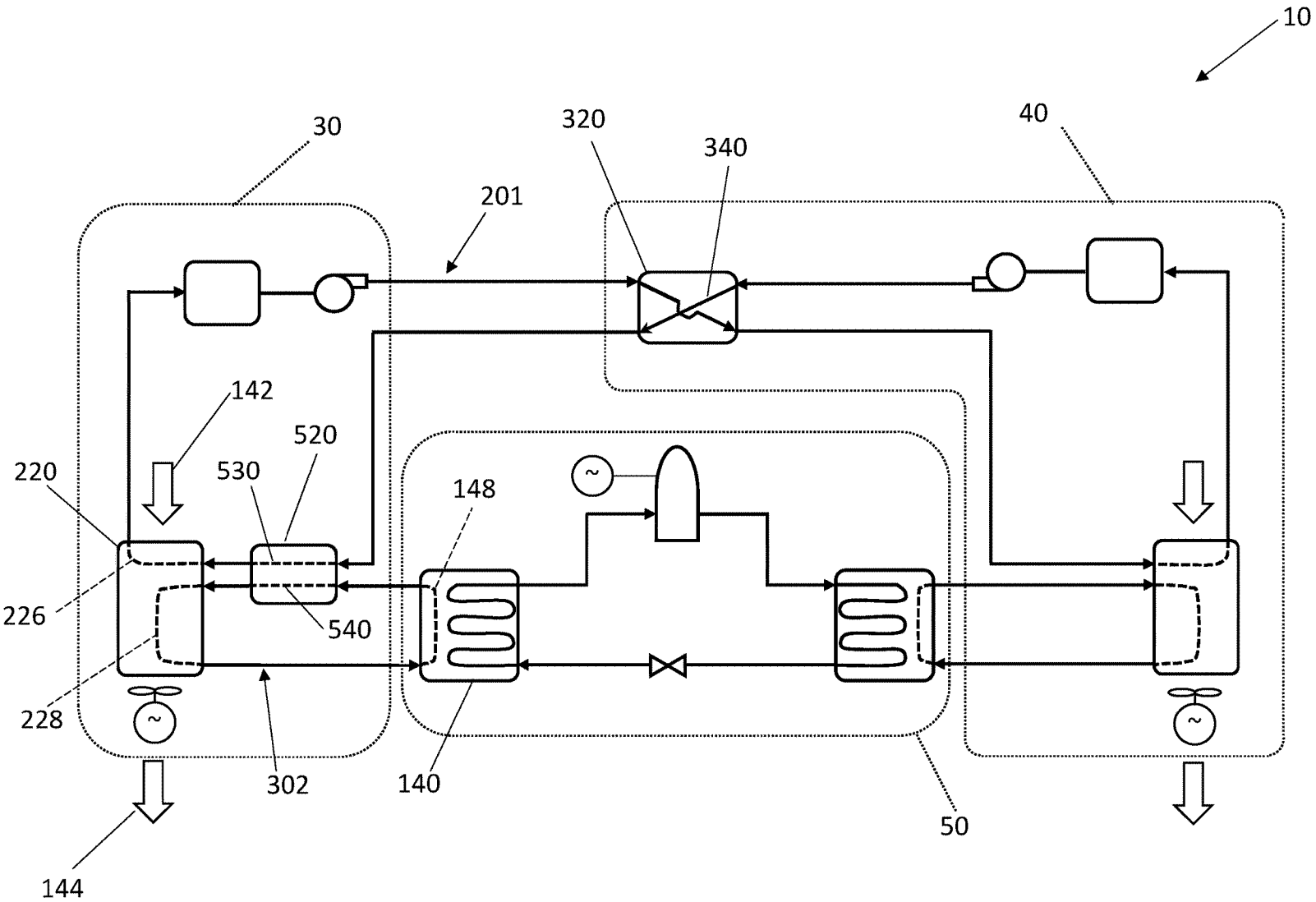
FIG. 6 is a schematic view of another exemplary embodiment of the conditioning system including a heat exchanger in a second configuration.

With reference to FIG. 6, the heat exchanger 520 may alternatively be part of the conditioner 30. In the illustrated embodiment, the first path 530 is downstream of the liquid desiccant heat exchanger 320 in the first loop 201 such that liquid desiccant flows from the second liquid desiccant path 340 of the liquid desiccant heat exchanger 320 to the first path 530 of the heat exchanger 520. The first path 530 is also upstream of the first mass exchange device 220 such that liquid desiccant flows from the first path 530 of the heat exchanger 520 to the first cavity 226 of the first mass exchange device 220.

The second path 540 of the heat exchanger 520 is downstream of the evaporator 140 in the second loop 302 such that the first heat transfer fluid flows from the second conditioning path 148 of the evaporator 140 to the second path 540 of the heat exchanger 520. The second path 540 is also upstream of the first mass exchange device 220 such that the first heat transfer fluid flows from the second path 540 of the heat exchanger 520 to the first conditioning path 228 of the first mass exchange device 220. The first and second paths 530, 540 of the heat exchanger 520 are thermally coupled such that the first heat transfer fluid in the second path 540 absorbs heat from the liquid desiccant in the first path 530, cooling the liquid desiccant and increasing its capacity to absorb moisture from the first airflow 142, thereby improving the performance and efficiency of the conditioner 30.

Figure 7:
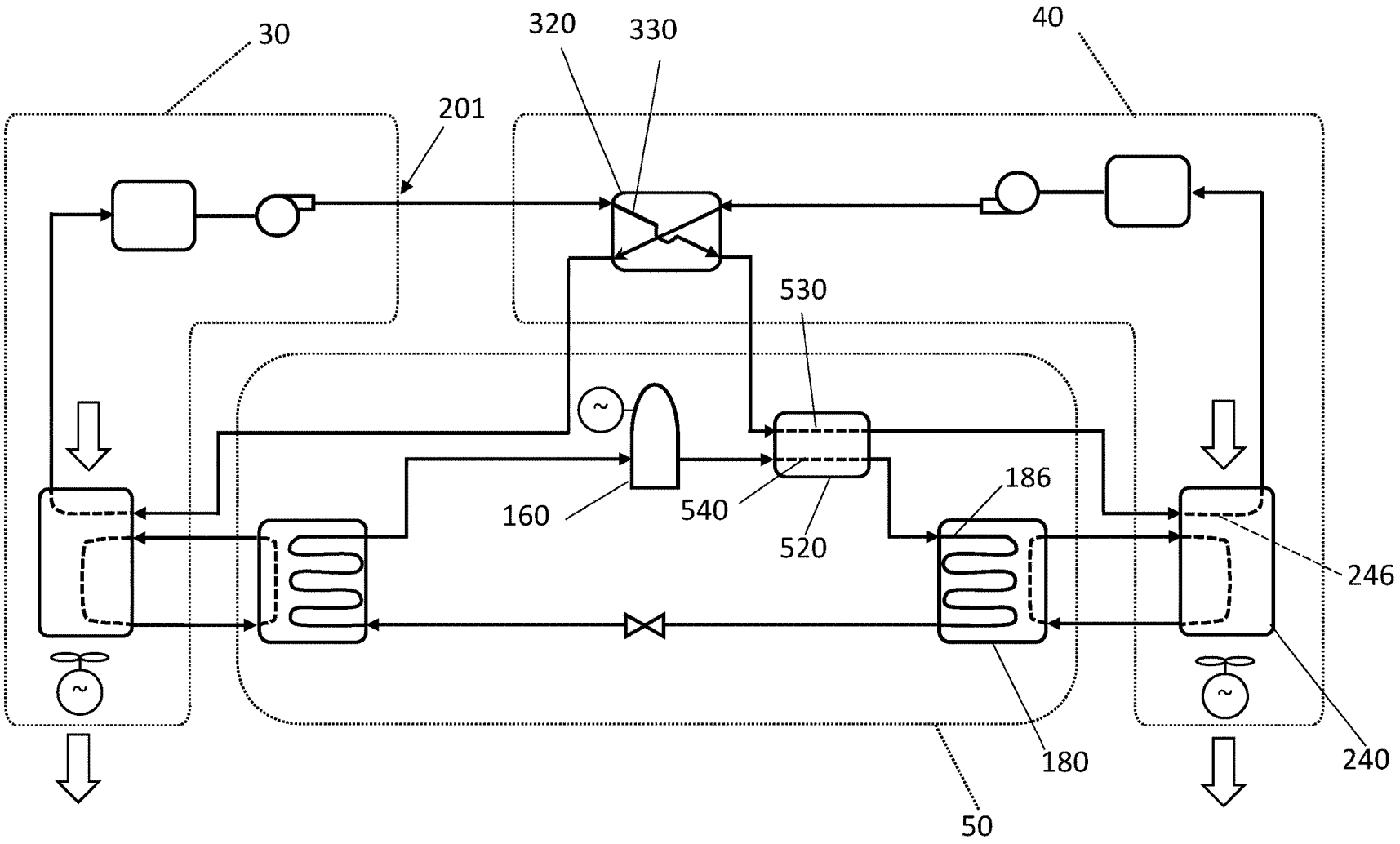
FIG. 7 is a schematic view of another exemplary embodiment of the conditioning system including a heat exchanger in a third configuration.

With reference to FIG. 7, the heat exchanger 520 may alternatively be part of the chiller 50. In the illustrated embodiment, the first path 530 of the heat exchanger 520 is downstream of the liquid desiccant heat exchanger 320 in the first loop 201 such that liquid desiccant flows from the first liquid desiccant path 330 of the liquid desiccant heat exchanger 320 to the first path 530 of the heat exchanger 520. The first path 530 is also upstream of the second mass exchange device 240 such that liquid desiccant flows from the first path 530 of the second cavity 246 of the second mass exchange device 240.

The second path 540 of the heat exchanger 520 is downstream of the compressor 160 in the fourth loop 304 such that refrigerant flows from the compressor 160 to the second path 540 of the heat exchanger 520. The second path 540 is also upstream of the condenser 180 such that refrigerant flows from the second path 540 of the heat exchanger 520 to the second refrigerant path 186 of the condenser. The first and second paths 530, 540 of the heat exchanger 520 are thermally coupled such that the liquid desiccant in the first path 530 absorbs heat from the refrigerant in the second path 540, warming the liquid desiccant and increasing its capacity to release moisture into the second airflow 192, thereby improving the performance and efficiency of the regenerator 40.

Figure 8:
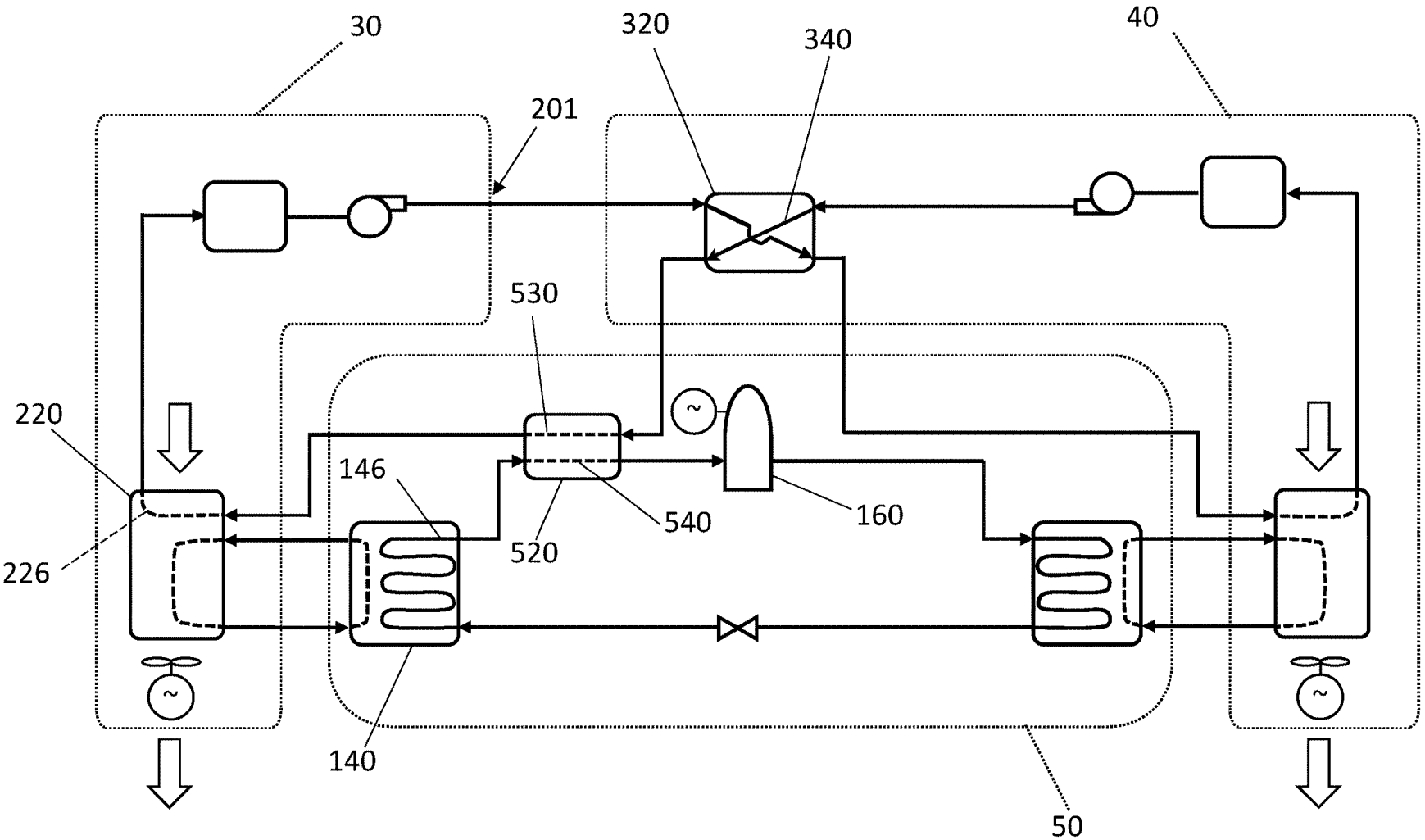
FIG. 8 is a schematic view of another exemplary embodiment of the conditioning system including a heat exchanger in a fourth configuration.

FIG. 8 illustrates the heat exchanger 520 as part of the chiller 50 in a second exemplary configuration. In the illustrated embodiment, the first path 530 of the heat exchanger 520 is downstream of the liquid desiccant heat exchanger 320 in the first loop 201 such that liquid desiccant flows from the second liquid desiccant path 340 of the liquid desiccant heat exchanger 320 to the first path 530 of the heat exchanger 520. The first path 530 is also upstream of the first mass exchange device 220 such that liquid desiccant flows from the first path 530 of the heat exchanger 520 to the first cavity 226 of the first mass exchange device 220.

The second path 540 of the heat exchanger 520 is downstream of the evaporator 140 such that refrigerant flows from the first refrigerant path of the evaporator to the second path 540 of the heat exchanger 520. The second path 540 is also upstream of the compressor 160 such that refrigerant flows from the second path 540 of the heat exchanger 520 to the compressor 160. The first and second paths 530, 540 of the heat exchanger 520 are thermally coupled such that the refrigerant in the second path 540 absorbs heat from the liquid desiccant in the first path 530, cooling the liquid desiccant and increasing its capacity to absorb moisture from the first airflow 142, thereby improving the performance and efficiency of the conditioner 30.

In some embodiments, and with reference to FIGS. 9-13, the conditioning system 10 may include more than one heat exchanger 520. In such embodiments, the heat exchanger 520 may be a first heat exchanger 520, and the conditioning system 10 may include a second heat exchanger 525. The second heat exchanger 525 may include a third path 535 in fluid communication with the humidity control system 200 to permit liquid desiccant to flow therethrough, and a fourth path 545 in fluid communication with the vapor compression system 300 to permit one of the first, second, or third heat transfer fluids to flow therethrough. The conditioning systems 10 in the embodiments illustrated in FIGS. 9-13 each include two heat exchangers 520, but the conditioning system 10 may include any suitable number of heat exchangers 520, for example and without limitation, three, four, or more.

Figure 9:
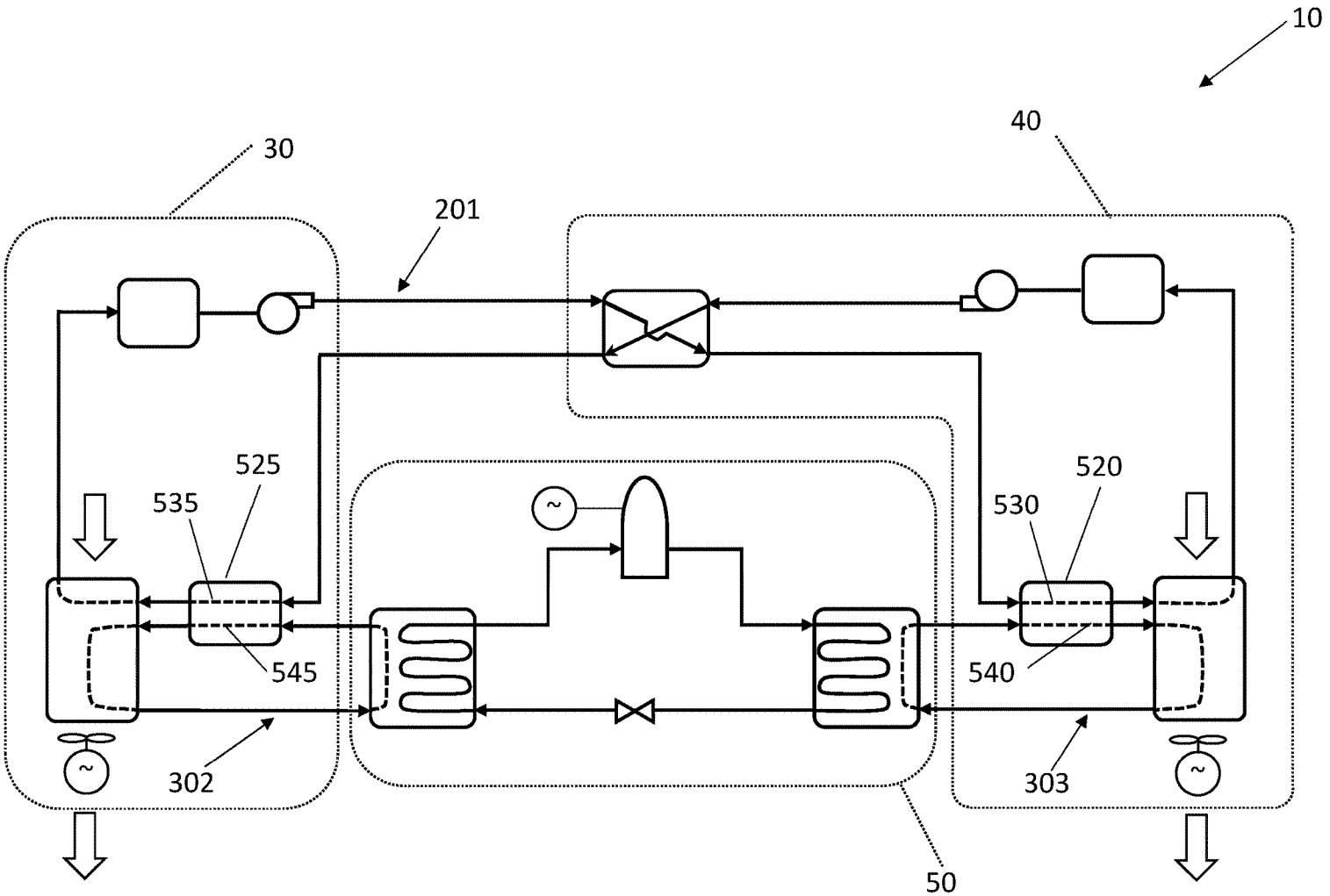
FIG. 9 is a schematic view of another exemplary embodiment of the conditioning system including a first heat exchanger in the first configuration shown in FIG. 5 and a second heat exchanger in the second configuration shown in FIG. 6.

FIG. 9 illustrates an example embodiment of the conditioning system 10 in which the regenerator 40 includes a first heat exchanger 520 and the conditioner 30 includes a second heat exchanger 525. The first heat exchanger 520 is installed in the configuration shown and described in relation to FIG. 5, and the second heat exchanger 525 is installed in the configuration shown and described in relation to FIG. 6. The first path 530 of the first heat exchanger 520 and the third path 535 of the second heat exchanger 525 are both fluidly connected to the first loop 201 (also referred to as the liquid desiccant loop) to permit liquid desiccant to flow therethrough. The second path 540 of the first heat exchanger 520 is fluidly connected to the third loop 303 (also referred to as the regenerating loop) to permit the second heat transfer fluid to flow therethrough. The fourth path 545 of the second heat exchanger 525 is fluidly connected to the second loop 302 (also referred to as the conditioning loop) to permit the first heat transfer fluid to flow therethrough.

Figure 10:
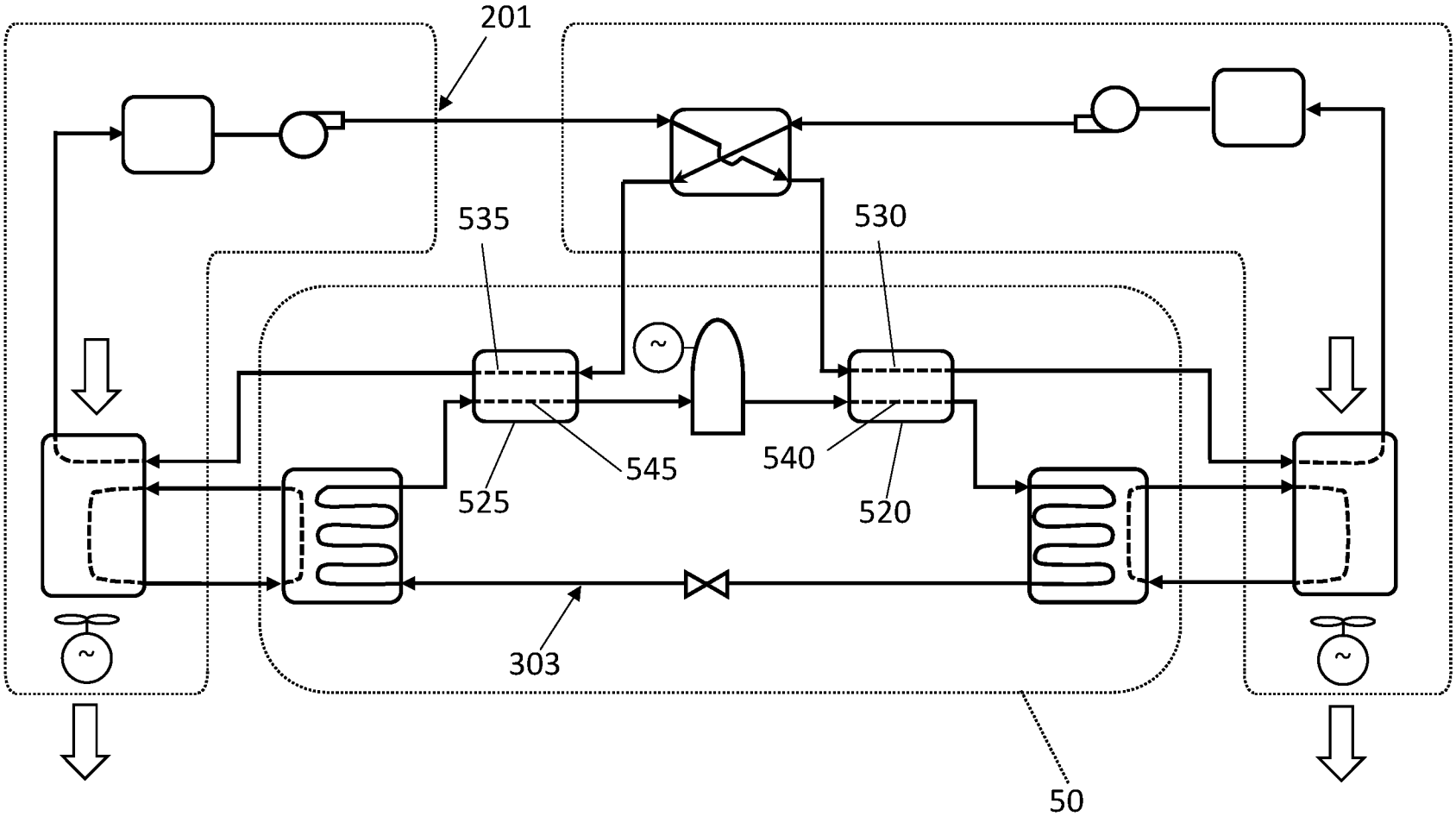
FIG. 10 is a schematic view of another exemplary embodiment of the conditioning system including a first heat exchanger in the third configuration shown in FIG. 7 and a second heat exchanger in the fourth configuration shown in FIG. 8.

FIG. 10 illustrates another example embodiment of the conditioning system 10 in which the chiller 50 includes a first heat exchanger 520 and a second heat exchanger 525. The first heat exchanger 520 is installed in the configuration shown and described in relation to FIG. 7, and the second heat exchanger 525 is installed in the in the configuration shown and described in relation to FIG. 8. The first path 530 of the first heat exchanger 520 and the third path 535 of the second heat exchanger 525 are both fluidly connected to the first loop 201 to permit liquid desiccant to flow therethrough. The second path 540 of the first heat exchanger 520 and the fourth path 545 of the second heat exchanger 525 are fluidly connected to the fourth loop 304 to permit refrigerant to flow therethrough.

Figure 11:
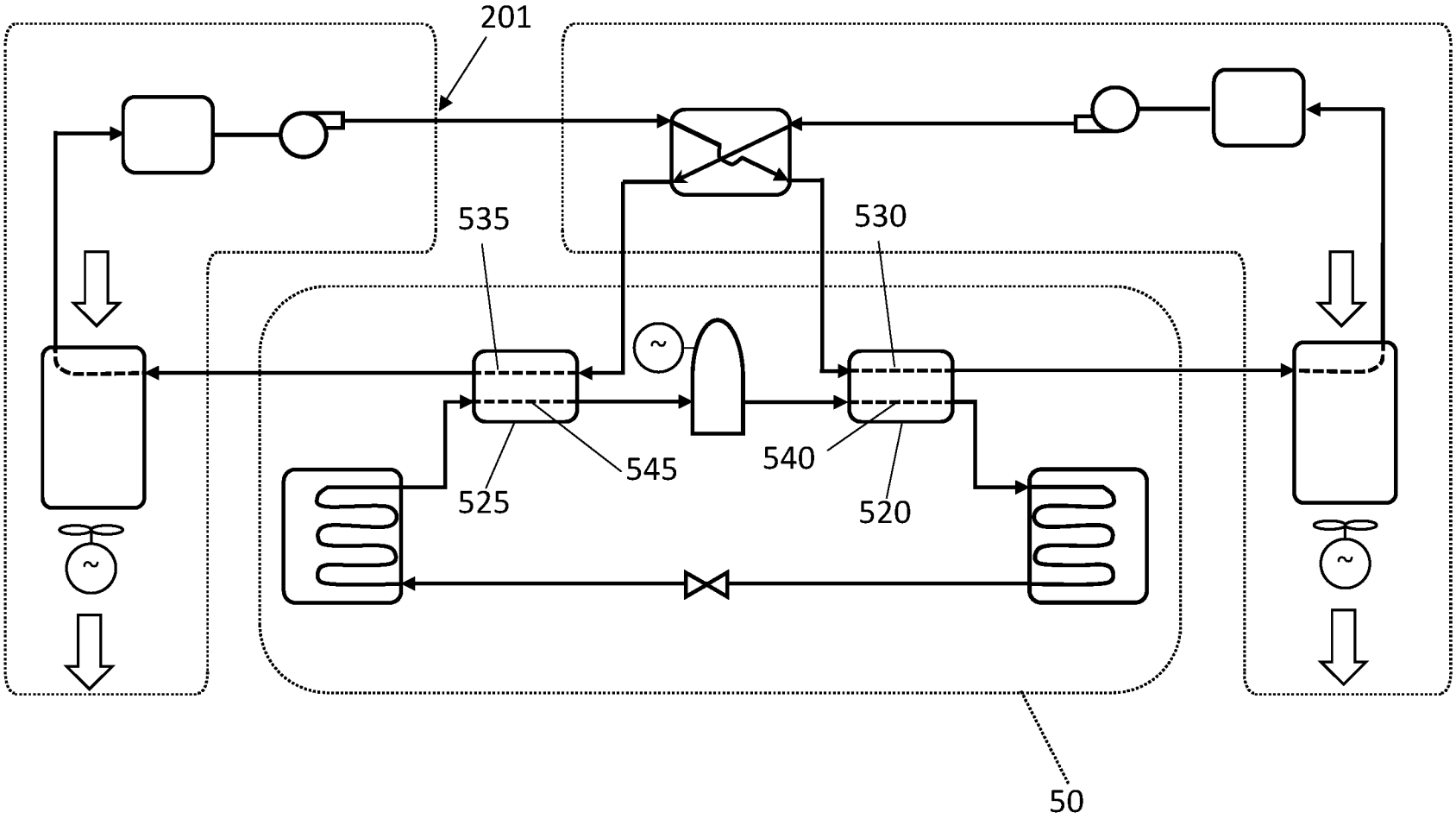
FIG. 11 is a schematic view of an alternative embodiment of the conditioning system shown in FIG. 10.

FIG. 11 illustrates an additional example embodiment of the conditioning system 10 in which the chiller 50 includes a first heat exchanger 520 and a second heat exchanger 525. The conditioning system 10 of the illustrated embodiment includes the first loop 201 for providing a flow of liquid desiccant and the fourth loop 304 for providing a flow of refrigerant, but does not include the second or third loops 302, 303 for providing a respective flow of the first heat transfer fluid or the second heat transfer fluid. The first and second heat exchangers 520, 525 are configured as shown and described in relation to FIG. 10. Such a conditioning system 10 including only the first and fourth loops 201, 304 may include any suitable number of heat exchangers, for example and without limitation, zero, one, two (as illustrated), three, or more.

Figure 12:
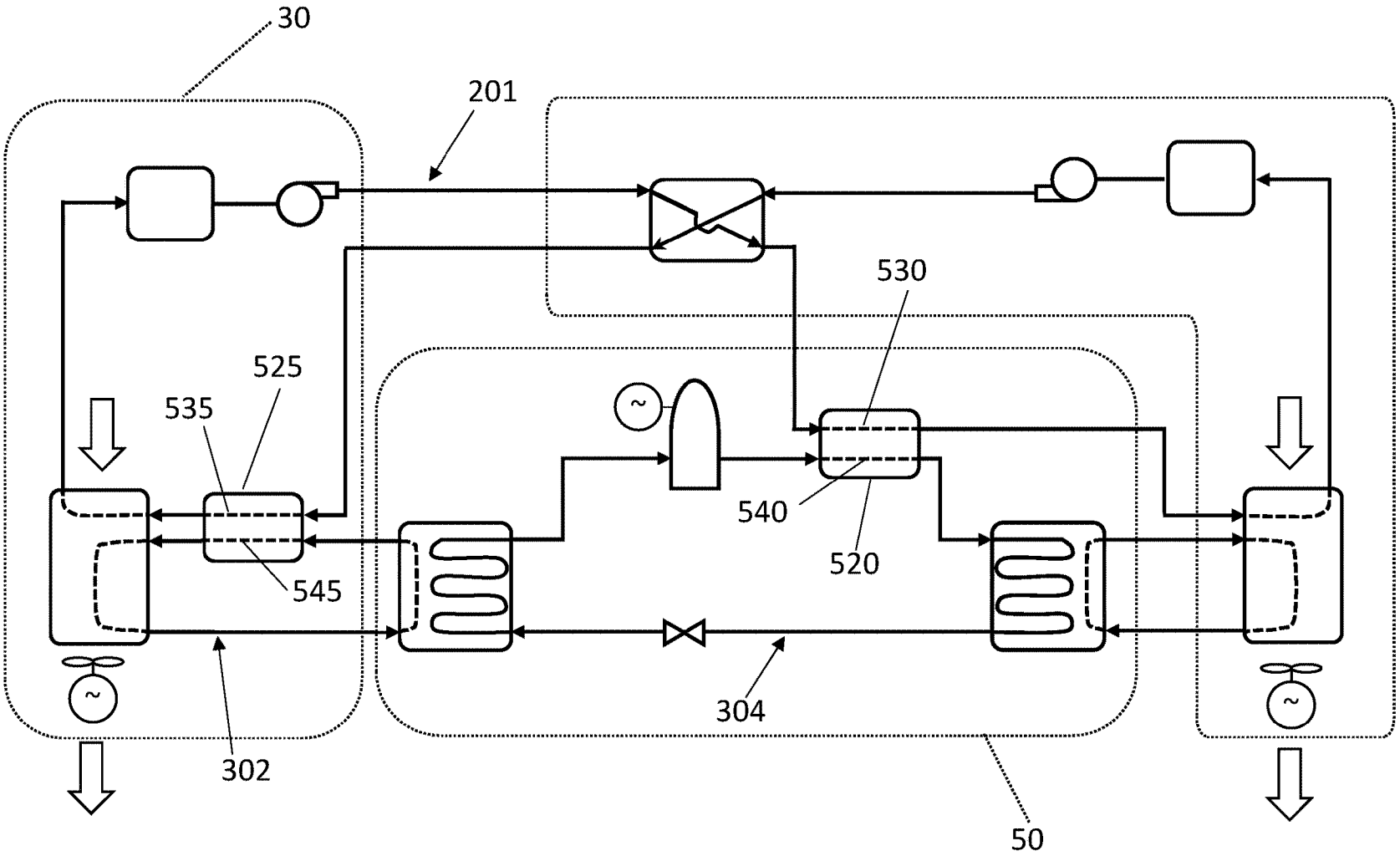
FIG. 12 is a schematic view of another exemplary embodiment of the conditioning system including a first heat exchanger in the third configuration shown in FIG. 7 and a second heat exchanger in the second configuration shown in FIG. 6.

FIG. 12 illustrates an example embodiment of the conditioning system 10 in which the chiller 50 includes a first heat exchanger 520 and the conditioner 30 includes a second heat exchanger 525. The first heat exchanger 520 is installed in the configuration shown and described in relation to FIG. 7, and the second heat exchanger 525 is installed in the in the configuration shown and described in relation to FIG. 6. The first path 530 of the first heat exchanger 520 and the third path 535 of the second heat exchanger 525 are both fluidly connected to the first loop 201 to permit liquid desiccant to flow therethrough. The second path 540 of the first heat exchanger 520 is fluidly connected to the fourth loop 304 to permit refrigerant to flow therethrough. The fourth path 545 of the second heat exchanger 525 is fluidly coupled to the second loop 302 to permit the first heat transfer fluid to flow therethrough.

Figure 13:
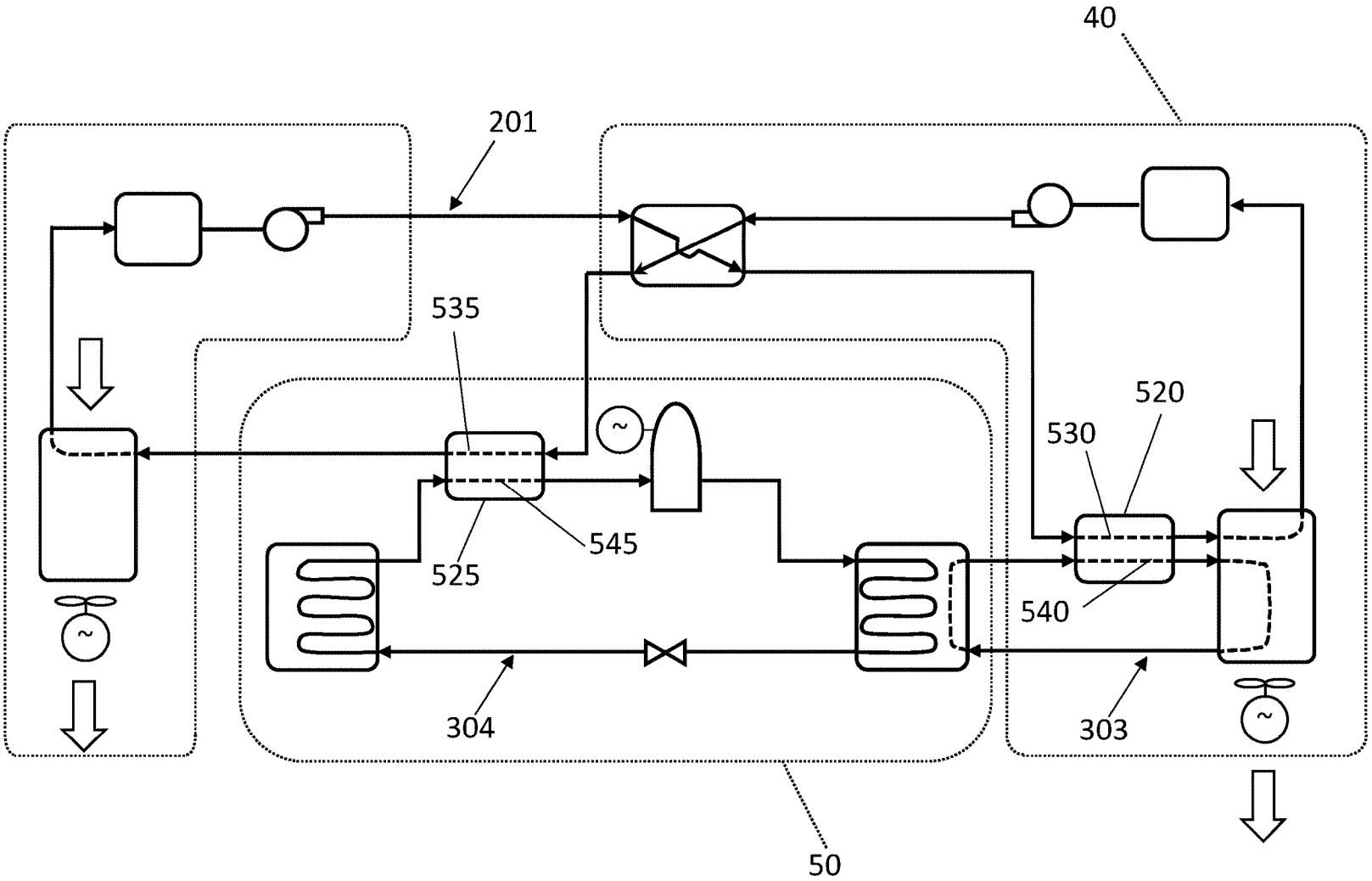
FIG. 13 is a schematic view of another exemplary embodiment of the conditioning system including a first heat exchanger in the first configuration shown in FIG. 5 and a second heat exchanger in the fourth configuration shown in FIG. 8.

FIG. 13 illustrates an example embodiment of the conditioning system 10 in which the regenerator 40 includes a first heat exchanger 520 and the chiller 50 includes a second heat exchanger 525. The first heat exchanger 520 is installed in the configuration shown and described in relation to FIG. 5, and the second heat exchanger 525 is installed in the in the configuration shown and described in relation to FIG. 8. The first path 530 of the first heat exchanger 520 and the third path 535 of the second heat exchanger 525 are both fluidly connected to the first loop 201 to permit liquid desiccant to flow therethrough. The second path 540 of the first heat exchanger 520 is fluidly connected to the third loop 303 to permit the second heat transfer fluid to flow therethrough. The fourth path 545 of the second heat exchanger 525 is fluidly coupled to the fourth loop 304 to permit refrigerant to flow therethrough.

The first and second heat exchangers 520, 525 may have any suitable construction that allows the conditioning system 10 to function as described herein. For example, each heat exchanger 520, 525 may be a plate heat exchanger, a coaxial heat exchanger, a shell and tube heat exchanger, or it may have any other suitable configuration. The heat exchangers 520, 525 may be constructed from copper, aluminum, stainless steel, titanium, polymer, or any suitable material that is compatible with the liquid desiccant and respective heat transfer fluid. In some embodiments (not shown), the second path 540 of the first heat exchanger 520 may be connected to an external heating source, rather than to the condenser 180. Additionally or alternatively, the fourth path 545 of the second heat exchanger 525 may be connected to an external cooling source, rather than to the evaporator 140.

Figure 14:
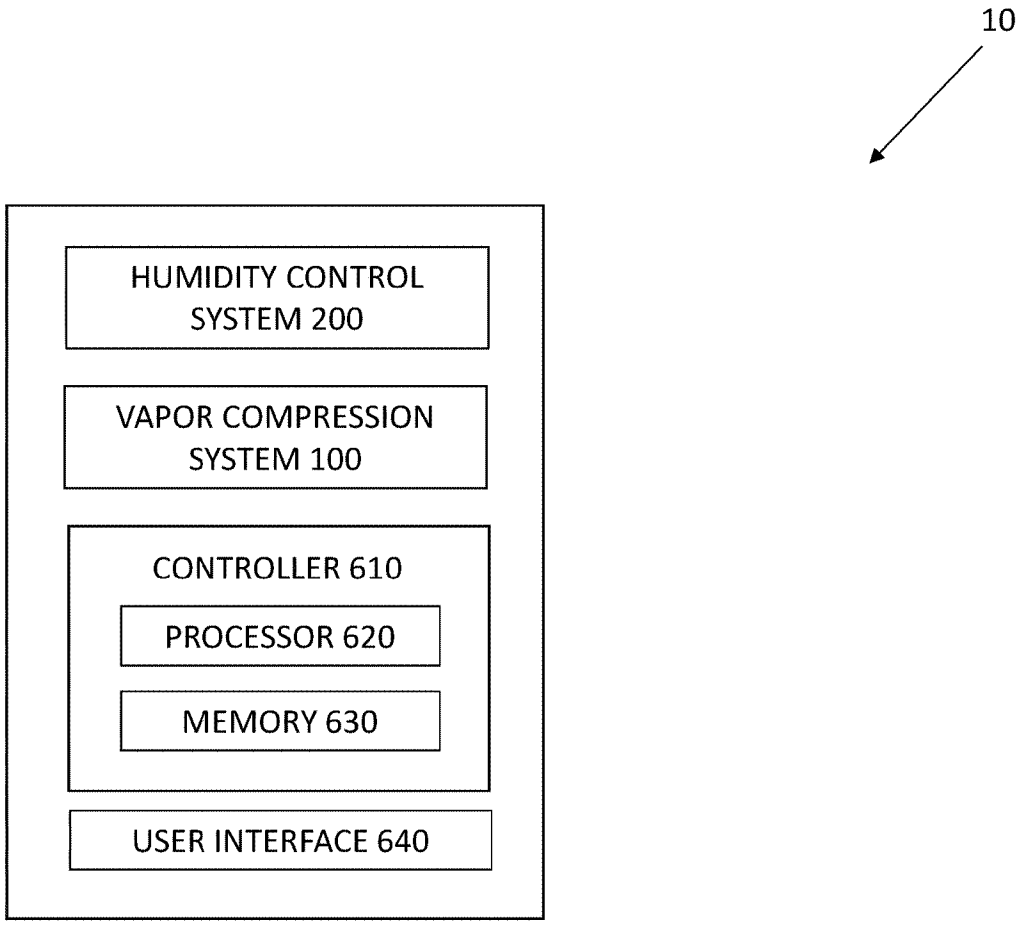
FIG. 14 is a block diagram of a control system for the conditioning system shown in FIGS. 1-13.

With reference to FIG. 14, the conditioning system 10 includes a controller 610 for controlling the temperature and humidity of the conditioned interior space 60. The controller 610 includes a processor 620 and a memory 630. The memory 630 stores instructions that program the processor 620 to operate the vapor compression system 300 to control the temperature of the conditioned interior space 60 to a temperature setpoint, and to operate the humidity control system 200 in conjunction with the vapor compression system 300 to control the humidity in the conditioned interior space 60 to a humidity setpoint. The controller 610 is configured to control at least one operating parameter of the conditioning system 10, for example and without limitation, a speed of the first or second fan 150, 190, a speed of the compressor 160, or a speed of the at least one pump 210. The controller 610 can control these parameters in response to at least one measured or calculated property of the air in the conditioned interior space 60, for example and without limitation, a dew point temperature, wet bulb temperature, partial pressure of water vapor, or humidity ratio.

The conditioning system 10 further includes a user interface 640 configured to output (e.g., display) and/or receive information (e.g., from a user) associated with the conditioning system 10. In some embodiments, the user interface 640 is configured to receive an activation and/or deactivation input from a user to activate and deactivate (i.e., turn on and off) or otherwise enable operation of the conditioning system 10. For example, the user interface 640 can receive a temperature setpoint and a humidity setpoint specified by the user. Moreover, in some embodiments, the user interface 640 is configured to output information associated with one or more operational characteristics of the conditioning system 10, including, for example and without limitation, warning indicators such as severity alerts, occurrence alerts, fault alerts, motor speed alerts, and any other suitable information.

The user interface 640 may include any suitable input devices and output devices that enable the user interface 640 to function as described herein. For example, the user interface 640 may include input devices including, but not limited to, a keyboard, mouse, touchscreen, joystick(s), throttle(s), buttons, switches, and/or other input devices. Moreover, the user interface 640 may include output devices including, for example and without limitation, a display (e.g., a liquid crystal display (LCD) or an organic light emitting diode (OLED) display), speakers, indicator lights, instruments, and/or other output devices. Furthermore, the user interface 640 may be part of a different component, such as a system controller (not shown). Other embodiments do not include a user interface 640.

The controller 610 is generally configured to control operation of the conditioning system 10. The controller 610 controls operation through programming and instructions from another device or controller or is integrated with the conditioning system 10 through a system controller. In some embodiments, for example, the controller 610 receives user input from the user interface 640, and controls one or more components of the conditioning system 10 in response to such user inputs. For example, the controller 610 may control the first fan 150 based on user input received from the user interface 640. In some embodiments, the conditioning system 10 may be controlled by a remote control interface. For example, the conditioning system 10 may include a communication interface (not shown) configured for connection to a wireless control interface that enables remote control and activation of the conditioning system 10. The wireless control interface may be embodied on a portable computing device, such as a tablet or smartphone.

The controller 610 may generally include any suitable computer and/or other processing unit, including any suitable combination of computers, processing units and/or the like that may be communicatively coupled to one another and that may be operated independently or in connection within one another (e.g., controller 610 may form all or part of a controller network). Controller 610 may include one or more modules or devices, one or more of which is enclosed within the conditioning system 10, or may be located remote from the conditioning system 10. The controller 610 may be part of the vapor compression system 300, the humidity control system 200, or separate and may be part of a system controller in an HVAC system. Controller 610 and/or components of controller 610 may be integrated or incorporated within other components of the conditioning system 10. The controller 610 may include one or more processor(s) 620 and associated memory device (s) 630 configured to perform a variety of computer-implemented functions (e.g., performing the calculations, determinations, and functions disclosed herein).

As used herein, the term "processor" refers not only to integrated circuits, but also to a controller, a microcontroller, a microcomputer, a programmable logic controller (PLC), an application-specific integrated circuit, and other programmable circuits. Additionally, memory device(s) 630 of controller 610 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 630 may generally be configured to store suitable computer-readable instructions that, when implemented by the processor(s) 620, configure or cause the controller 610 to perform various functions described herein including, but not limited to, controlling the conditioning system 10, receiving inputs from user interface 640, providing output to an operator via user interface 640, and/or various other suitable computer-implemented functions.

Technical benefits of the systems described herein are as follows: (1) a single conditioning system can be controlled to cool, heat, humidify, and/or dehumidify an interior space, (2) the performance and efficiency of the conditioner and the regenerator are improved by optimizing the locations of heat transfer between different parts of the system.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A conditioning system comprising:

a humidity control system including:

a first fan for producing a first airflow toward a conditioned interior space;

a first mass exchange device positioned in the first airflow;

a second fan for producing a second airflow toward an exterior space; and a second mass exchange device positioned in the second airflow, wherein the first mass exchange device and the second mass exchange device are coupled in fluid communication to permit a liquid desiccant to flow in a first loop therebetween and therethrough;

a vapor compression system including:

an evaporator coupled in fluid communication with the first mass exchange device to permit a first heat transfer fluid to flow in a second loop therebetween; and a condenser coupled in fluid communication with the second mass exchange device to permit a second heat transfer fluid to flow in a third loop therebetween, wherein the evaporator and condenser are coupled in fluid communication to permit a third heat transfer fluid to flow in a fourth loop, the first mass exchange device is configured to thermally couple the first heat transfer fluid to the liquid desiccant flowing therethrough, and the second mass exchange device is configured to thermally couple the second heat transfer fluid to the liquid desiccant flowing therethrough; and a heat exchanger having a first path in fluid communication with the first loop of the humidity control system to permit the liquid desiccant to flow therethrough in series with the first mass exchange device or the second mass exchange device and a second path thermally coupled to the first path and in fluid communication with the vapor compression system to permit one of the first, second, or third heat transfer fluids to flow therethrough.

2. The conditioning system of claim 1, wherein the first and second heat transfer fluids are water, and the third heat transfer fluid is a refrigerant.

3. The conditioning system of claim 1, wherein the first path of the heat exchanger is upstream of the second mass exchange device in the first loop, and the second path of the heat exchanger is downstream of the condenser in the third loop to permit the second heat transfer fluid to flow therethrough.

4. The conditioning system of claim 1, wherein the first path of the heat exchanger is upstream of the first mass exchange device in the first loop, and the second path of the heat exchanger is downstream of the evaporator in the second loop to permit the first heat transfer fluid to flow therethrough.

5. The conditioning system of claim 1, wherein the first path of the heat exchanger is upstream of the second mass exchange device in the first loop, and the second path of the heat exchanger is upstream of the condenser in the fourth loop to permit the third heat transfer fluid to flow therethrough.

6. The conditioning system of claim 1, wherein the first path of the heat exchanger is upstream of the first mass exchange device in the first loop, and the second path of the heat exchanger is downstream of the evaporator in the fourth loop to permit the third heat transfer fluid to flow therethrough.

7. The conditioning system of claim 1, wherein the heat exchanger is a first heat exchanger, and the conditioning system further comprises a second heat exchanger having a third path in fluid communication with the humidity control system to permit the liquid desiccant to flow therethrough and a fourth path in fluid communication with the vapor compression system to permit one of the first, second, or third heat transfer fluids to flow therethrough.

8. The conditioning system of claim 7, wherein the second path of the first heat exchanger is fluidly connected to the third loop to permit the second heat transfer fluid to flow therethrough, and the fourth path of the second heat exchanger is fluidly connected to the second loop to permit the first heat transfer fluid to flow therethrough.

9. The conditioning system of claim 7, wherein the second path of the first heat exchanger and the fourth path of the second heat exchanger are fluidly connected to the fourth loop to permit the third heat transfer fluid to flow therethrough.

10. The conditioning system of claim 1, wherein the humidity control system further comprises a supplemental heat exchanger coupled in fluid communication with the first mass exchange device and the second mass exchange device, the supplemental heat exchanger including a first liquid desiccant path for providing the liquid desiccant in a first direction from the first mass exchange device to the second mass exchange device, and a second liquid desiccant path for providing the liquid desiccant in a second direction from the second mass exchange device to the first mass exchange device, wherein the first liquid desiccant path is thermally coupled to the second liquid desiccant path.

11. A conditioning system comprising:

a chiller including:

an evaporator; and a condenser, wherein the evaporator and the condenser are coupled in fluid communication to permit a refrigerant to flow in a refrigerant loop therebetween;

a conditioner including:

a first fan for producing a first airflow toward a conditioned interior space; and a first mass exchange device positioned in the first airflow, wherein the conditioner is fluidly connected to the chiller to permit a first heat transfer fluid to flow in a conditioning loop between the first mass exchange device and the evaporator; and a regenerator including:

a second fan for producing a second airflow toward an exterior space; and a second mass exchange device positioned in the second airflow, wherein the regenerator is fluidly coupled to the chiller to permit a second heat transfer fluid to flow in a regenerating loop between the second mass exchange device and the condenser, and wherein the regenerator is fluidly coupled to the conditioner to permit a liquid desiccant to flow in a liquid desiccant loop between and through the second mass exchange device and the first mass exchange device, wherein at least one of the chiller, the regenerator, or the conditioner includes a heat exchanger having a first path in fluid communication with the liquid desiccant loop to permit the liquid desiccant to flow therethrough in series with the first mass exchange device or the second mass exchange device, and a second path thermally coupled to the first path and in fluid communication with one of the refrigerant loop, conditioning loop, or regenerating loop to permit one of the refrigerant, first heat transfer fluid, or second heat transfer fluid to flow therethrough.

12. The conditioning system of claim 11, wherein the first and second heat transfer fluids are water.

13. The conditioning system of claim 11, wherein the first path of the heat exchanger is upstream of the second mass exchange device in the liquid desiccant loop, and the second path of the heat exchanger is upstream of the condenser in the refrigerant loop to permit the refrigerant to flow therethrough.

14. The conditioning system of claim 11, wherein the first path of the heat exchanger is upstream of the first mass exchange device in the liquid desiccant loop, and the second path of the heat exchanger is downstream of the evaporator in the refrigerant loop to permit the refrigerant to flow therethrough.

15. The conditioning system of claim 11, wherein the first path of the heat exchanger is upstream of the second mass exchange device in the liquid desiccant loop, and the second path of the heat exchanger is downstream of the condenser in the regenerating loop to permit the second heat transfer fluid to flow therethrough.

16. The conditioning system of claim 11, wherein the first path of the heat exchanger is upstream of the first mass exchange device in the liquid desiccant loop, and the second path of the heat exchanger is downstream of the evaporator in the conditioning loop to permit the first heat transfer fluid to flow therethrough.

17. The conditioning system of claim 11, wherein the heat exchanger is a first heat exchanger, and the conditioning system further comprises a second heat exchanger having a third path in fluid communication with the liquid desiccant loop to permit the liquid desiccant to flow therethrough and a fourth path in fluid communication with one of the refrigerant loop, conditioning loop, or regenerating loop to permit one of the refrigerant, first heat transfer fluid, or second heat transfer fluid to flow therethrough.

18. The conditioning system of claim 17, wherein the second path of the first heat exchanger is configured to permit the second heat transfer fluid to flow therethrough, and the fourth path of the second heat exchanger is configured to permit the first heat transfer fluid to flow therethrough.

19. The conditioning system of claim 17, wherein the second path of the first heat exchanger and the fourth path of the second heat exchanger are configured to permit the refrigerant to flow therethrough.

20. The conditioning system of claim 11, wherein the regenerator further comprises a supplemental heat exchanger coupled in fluid communication with the first mass exchange device and the second mass exchange device, the supplemental heat exchanger including a first liquid desiccant path for providing the liquid desiccant in a first direction from the first mass exchange device to the second mass exchange device, and a second liquid desiccant path for providing the liquid desiccant in a second direction from the second mass exchange device to the first mass exchange device, wherein the first liquid desiccant path is thermally coupled to the second liquid desiccant path.

* * * * *